US005669043A

United States Patent [19]

Nishino et al.

[11] Patent Number: 5,669,043

[45] Date of Patent: *Sep. 16, 1997

[54] FILM PHOTOCONDUCTOR HOLDING MECHANISM

[75] Inventors: Shinichi Nishino; Osamu Nishino; Toshitaka Ogawa, all of Ibaraki, Japan

[73] Assignee: Hitachi Koki Co., Ltd., Tokyo, Japan

[ * ] Notice: The term of this patent shall not extend beyond the expiration date of Pat. No. 5,630,197.

[21] Appl. No.: 676,842

[22] Filed: Jul. 8, 1996

Related U.S. Application Data

[63] Continuation of Ser. No. 642,667, May 3, 1996, Pat. No. 5,630,197, which is a continuation of Ser. No. 407,280, Mar. 20, 1995, abandoned, which is a continuation-in-part of Ser. No. 129,361, Sep. 30, 1993, abandoned.

[30] Foreign Application Priority Data

Sep. 30, 1992 [JP] Japan ..... 4-261187

[51] Int. Cl.[6] ..... G03G 15/02

[52] U.S. Cl. ..... 399/116; 399/161

[58] Field of Search ..... 355/200, 211, 355/212, 213, 72; 399/116, 159, 161, 166

[56] References Cited

U.S. PATENT DOCUMENTS

| | | | |
|---|---|---|---|
| 3,834,808 | 9/1974 | Takahashi et al. | 399/117 |
| 3,903,795 | 9/1975 | Suzuki . | |
| 4,040,732 | 8/1977 | Hummel | 399/161 |
| 4,231,652 | 11/1980 | Moser et al. | 355/213 |
| 4,273,438 | 6/1981 | Nishikawa | 355/213 X |
| 4,357,093 | 11/1982 | Caudill et al. | 355/200 |
| 4,400,083 | 8/1983 | Beisty et al. . | |
| 4,598,992 | 7/1986 | Landa et al. | 355/211 |
| 4,655,578 | 4/1987 | Kurtz et al. | 355/212 |
| 4,922,297 | 5/1990 | Kondo | 355/211 |
| 5,008,711 | 4/1991 | Sakamoto et al. | 355/211 X |
| 5,095,334 | 3/1992 | Nukaya | 355/210 |
| 5,142,305 | 8/1992 | Maslanka et al. | 346/138 |
| 5,255,056 | 10/1993 | Preszler et al. | 399/161 |
| 5,386,273 | 1/1995 | Wood et al. | 399/116 |
| 5,508,790 | 4/1996 | Belinkov et al. | 399/161 |

FOREIGN PATENT DOCUMENTS

| | | |
|---|---|---|
| 2840891 | 5/1980 | Germany . |
| 3146301 | 7/1982 | Germany . |
| 3240026 | 5/1983 | Germany . |
| 4139427 | 6/1992 | Germany . |

*Primary Examiner*—Robert Beatty

*Attorney, Agent, or Firm*—Sughrue, Mion, Zinn, Macpeak & Seas

[57] ABSTRACT

A film photoconductor holding mechanism includes a substantially-cylindrical support having an opening which is shaped so as to have a notch at a part of a circumferential portion of the support in a longitudinal direction thereof. A bar-like photoconductor cap which is operative to engage with the opening of the support is provided. A film assembly is provided and has a peripheral length larger than an outer peripheral length of the support and is installed into the support in a state where the bar-like photoconductor cap is opened and is held in the support by the bar-like photoconductor cap. A guide bar and elastic member is disposed on the film assembly for guiding and tensioning the installation of the film assembly in the support, and a guide groove is defined in the bar-like photoconductor cap and is operative to be engaged with the guide bar.

9 Claims, 11 Drawing Sheets

FILM PHOTOCONDUCTOR HOLDING MECHANISM

CROSS REFERENCE TO RELATED APPLICATIONS

This is a continuation of application Ser. No. 08/642,667 filed May 3, 1996, now U.S. Pat. No. 5,630,197 which is a continuation of application Ser. No. 08/407,280 filed Mar. 20, 1995, now abandoned which is a continuation-in-part of application Ser. No. 08/129,361 filed Sep. 30, 1993, now abandoned.

BACKGROUND OF THE INVENTION

1. Field of the Invention

The present invention relates to an image forming apparatus.

2. Discussion of the Related Art

The photoreceptor (i.e. photoconductor) unit for use in an image forming apparatus such as a facsimile device, a copying machine or a printer which forms an image by the electrophotographic process is categorized into a drum-shaped photoreceptor formed of a metal tube covered with a photoreceptor layer formed by vapor deposition or coating process, a so-called take-up type photoreceptor constructed such that a sheet-like photoreceptor is removably wound around a tubular support, a so-called clamp type photoreceptor constructed such that an endless photoreceptor is supported on the circumferential outer surface of a tubular support by means of a clamp mechanism provided in association with the tubular support, a belt-type photoreceptor constructed such that a photoreceptor shaped like an endless belt is internally supported by at least two rolls, and others. The photoreceptor materials currently used for the photoreceptor unit are Selenium (Se), organic photoconductive material (OPC), amorphous silicon (a-Si), zinc oxide, and the like.

In grouping plural types of image forming apparatus into different model series on the basis of printing speed, the systems of each different type of the apparatus are used. Accordingly, the cost of production is inevitably increased.

SUMMARY OF THE INVENTION

Accordingly, an object of the present invention is to enable image forming apparatus of different printing speeds or duties to be grouped into different model series, without increasing the production cost.

To achieve the above object, there is provided an image forming apparatus having a photoreceptor in which plural types of photoreceptor units, which are interchangeably set to the base machine of the image forming apparatus, are used for the photoreceptor.

With such a construction, the image forming apparatus can be grouped into different model series without increasing the cost of production.

It is a further object of the present invention to provide a film photoconductor holding mechanism, comprising:

a substantially-cylindrical support having an opening which is shaped so as to have a notch at a part of a circumferential portion of said support in a longitudinal direction thereof; a bar-like photoconductor cap which is operative to engage with said opening of said support; a film assembly having a peripheral length larger than an outer peripheral length of said support and being installed into said support in a state where the bar-like photoconductor cap is opened and being held in said support by the bar-like photoconductor cap; a guide bar, disposed on said film assembly, for guiding the installation of said film assembly in said support; and a guide groove defined in said bar-like photoconductor cap and engaged with said guide bar.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings.

DESCRIPTION OF THE PREFERRED EMBODIMENTS

The preferred embodiments of the present invention will be described with reference to the accompanying drawings.

Figure 1:
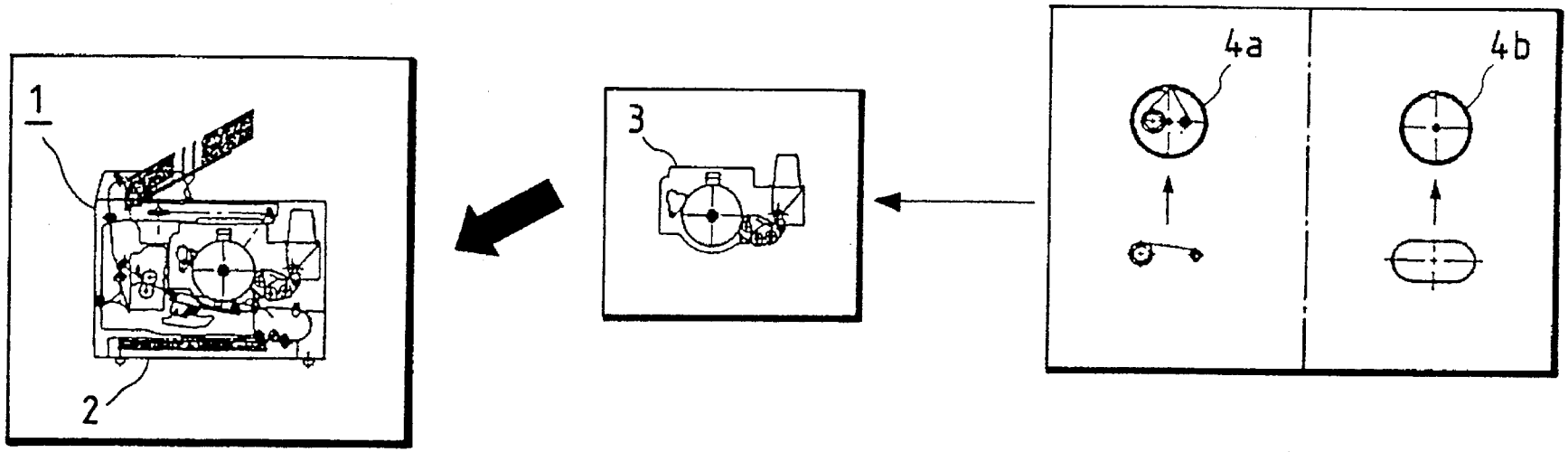
FIG. 1 is an explanatory diagram showing the relationship between the base machine of an image forming apparatus and the photoreceptor unit thereof.

FIG. 1 is an explanatory diagram showing the relationship between the base machine of an image forming apparatus and the photoreceptor unit thereof. The present embodiment employs two types of photoreceptor unit, that is, a take-up type photoreceptor unit 4*a* and a clamp type photoreceptor unit 4*b*. The photoreceptor units 4*a* and 4*b* are removably loaded into a print section module or print module 3 via an interface 38 (see FIG. 10). Loading the print module 3 into a machine frame 2 completes a base machine 1. The print module 3 and interface 38 form a mounting means.

Figure 10:
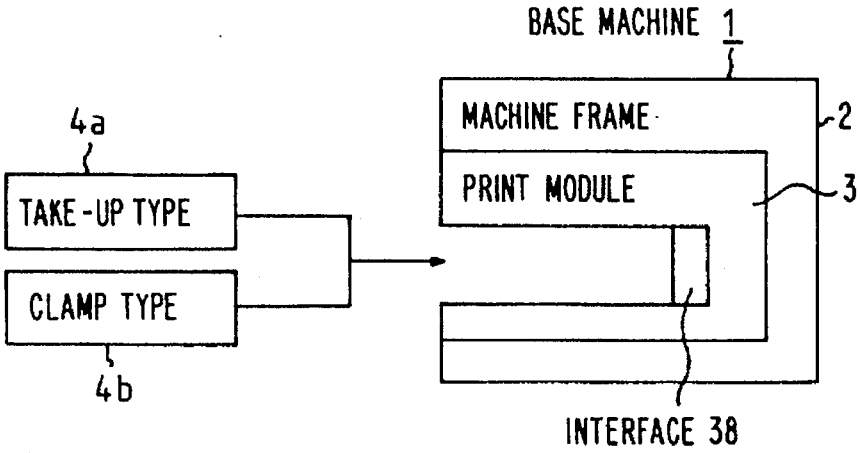
FIG. 10 is an explanatory diagram showing an interface disposed between a base machine and two photoreceptor units.

As shown schematically in FIG. 10, the interface 38 is freely disposed between the print module 3, which is detachably mounted on the base machine 1, and each of the photoreceptor units 4*a* and 4*b*. The interface 38 refers to a coupling portion between the print module 3 and the photoreceptor units 4*a*, 4*b*. The interface 38 is constituted by a mechanical interface such as a gear mechanism which is detachably engaged, etc., which transmits motive power to the photoreceptor unit, and an electrical interface which includes a signal transmission unit for controlling the rotation operation of the photoreceptor unit. More specifically, the mechanical interface performs coupling due to gears 44*a* and 44*b* for transmission of drive force to the photoreceptor units, and the electrical interface performs the engagement of a front frame 21 of the photoreceptor unit with an earth plate 51 (see, for example, FIGS. 2 and 11).

Figure 11:
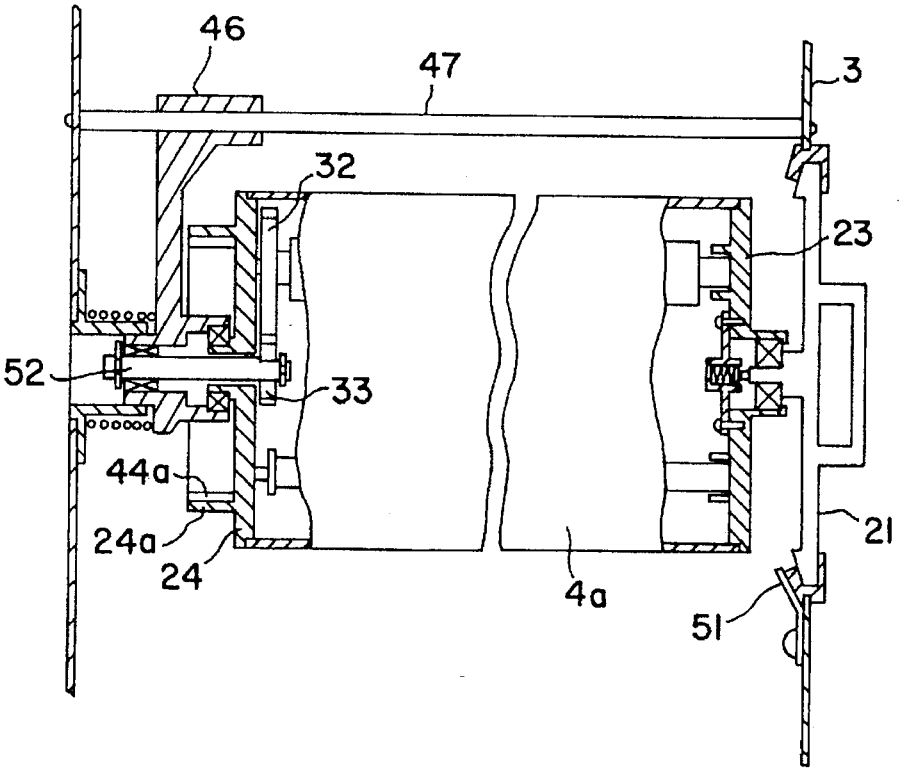
FIG. 11 is a diagram schematically illustrating a main structure in a state where the film take-up type photoreceptor unit 4*a* is fitted to the fitting part provided in the print module 3 for the photoreceptor unit.
Figure 12:
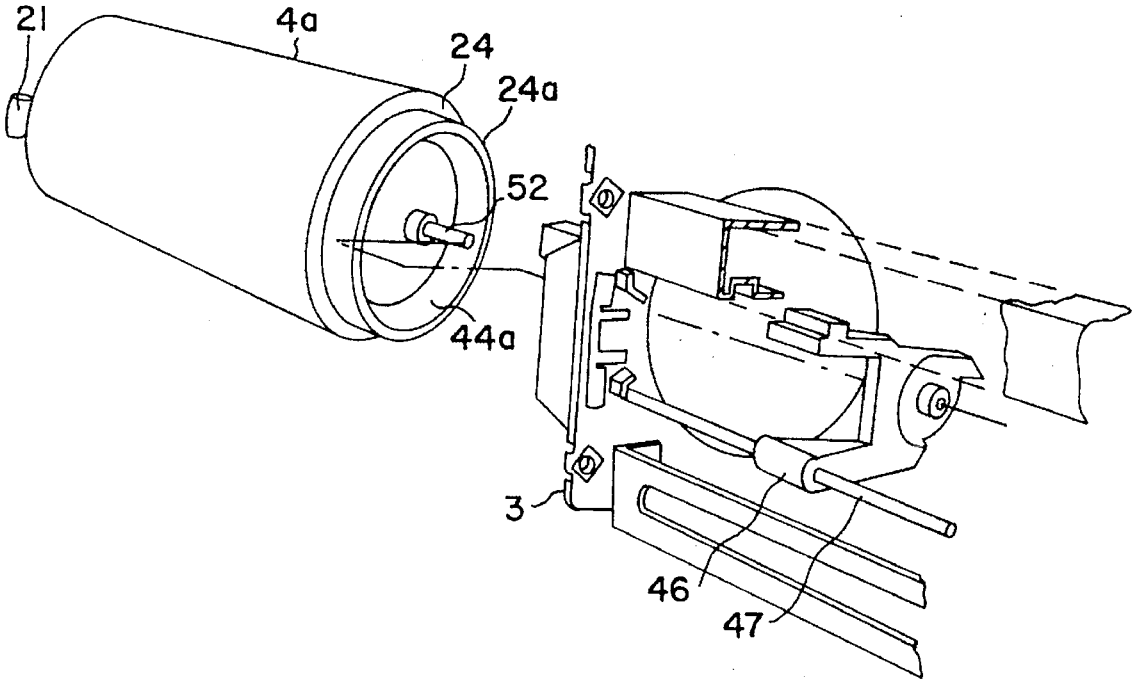
FIG. 12 is a perspective view illustrating a relationship between the print module and the photoreceptor unit.

A detailed description of the interface follows with reference to FIGS. 11 and 12.

FIG. 11 is a diagram schematically illustrating a main structure in a state where the film take-up type photoreceptor unit 4*a* is fitted to the fitting part provided in the print module 3 for the photoreceptor unit, and FIG. 12 is a perspective view illustrating a relationship between the print module 3 and the photoreceptor unit. As shown in the figures, a cylindrical projection 24*a* having a center which is coaxial with a drive shaft 52 is disposed on the side surface of a rear cap 24, and the gear 44*a* is formed in the inner peripheral surface of the projection 24*a*. The gear 44*a* is partially engaged with the gear 44*b* provided in the print module 3 when the photoreceptor is fitted to the print module 3.

A drum rear frame 46 has one end which is supported by a guide shaft 47 fixed to the print module 3 in such a manner that the drum rear frame 46 is slidable along the guide shaft 47. The drum rear frame 46 is used for guiding the photoreceptor unit up to a predetermined position when the photoreceptor unit is being inserted into the print module 3.

The earth plate 51 is fixed to a frame constituting the print module 3 and which is electrically grounded when a tip of the earth plate 51 is engaged with the front frame 21 of the photoreceptor unit.

With respect to the signal transmission unit, it is further contemplated that the signal transmission unit may include, for example, an identifying circuit for discriminating the photoreceptor unit. More specifically, in the case of considering the operational specification by a user, it would be helpful to provide a circuit for discriminating the particular photoreceptor unit and a plurality of control programs in advance. With such a structure, a suitable control program can be automatically changed in accordance with a change of the particular photoreceptor unit chosen by the user.

Figure 13:
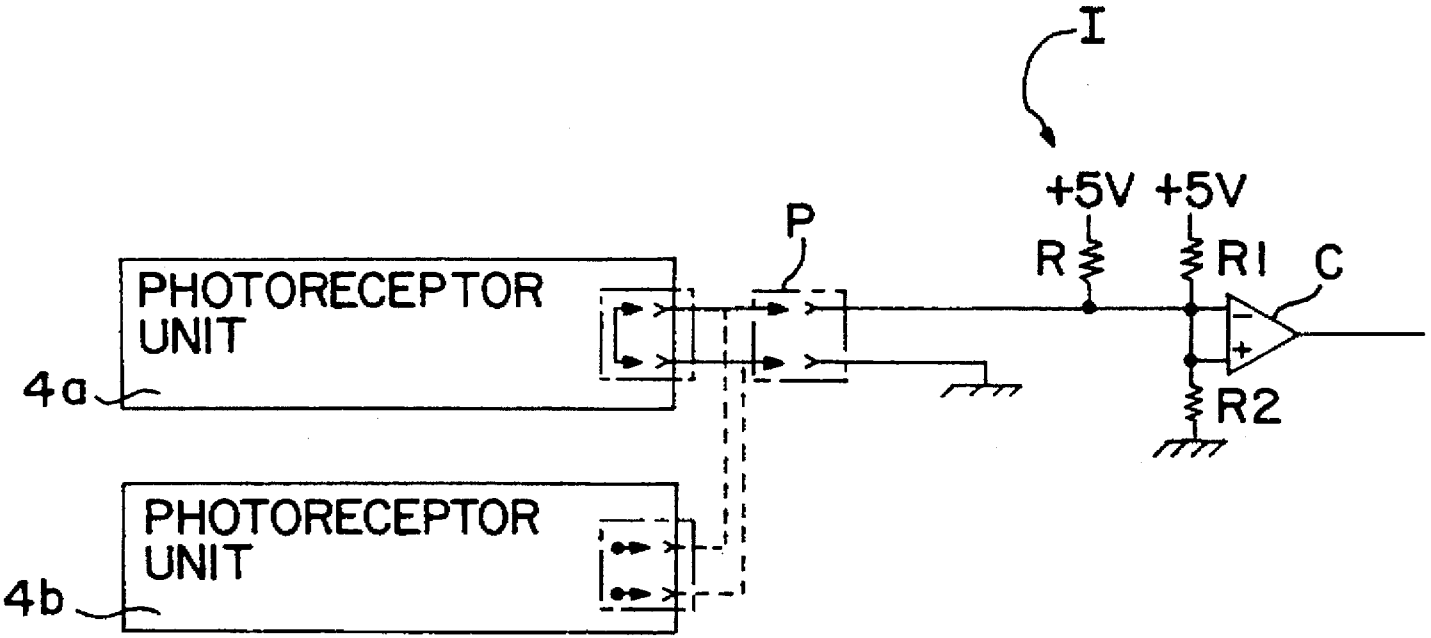
FIG. 13 is an explanatory diagram showing a photoreceptor unit identifying circuit.

FIG. 13 illustrates an example of an identifying circuit for discriminating a photoreceptor unit. In particular, when an output of a comparator C exceeds a predetermined voltage value (for example, 2 V), the identifying circuit I identifies that a photoreceptor unit 4*b* is used, and when the output of the comparator C is lower than the predetermined voltage (2 V), the circuit I identifies that a photoreceptor unit 4*a* is used.

The photoreceptor unit (4*a*, 4*b*) and the identifying circuit I can be readily connected through a known plug-in identifying means P such as a PC card or a connector.

Figure 2:
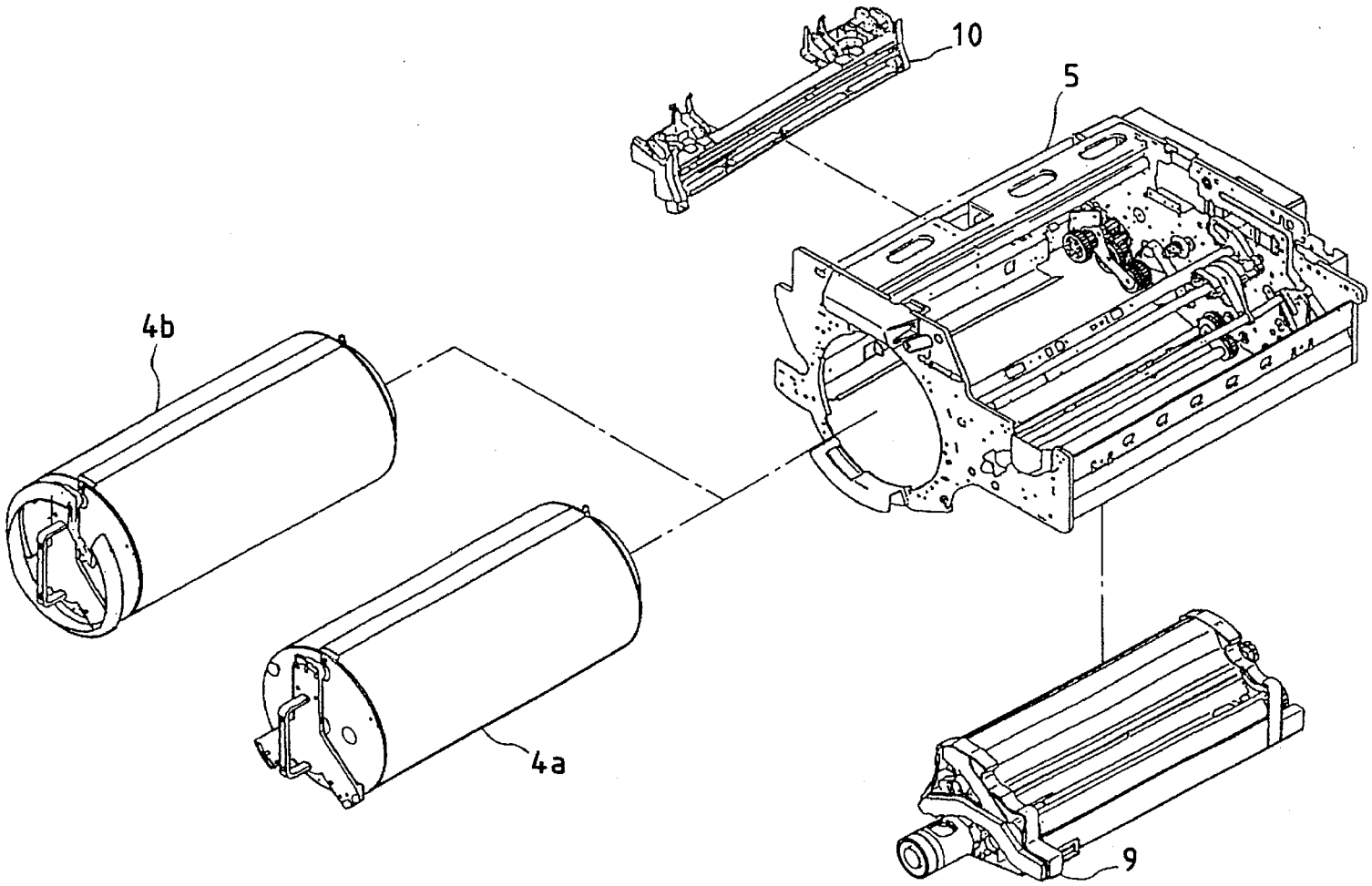
FIG. 2 is an exploded view in perspective showing the construction of a print module of FIG. 1.

In the exploded perspective view of the construction of the print module 3 as shown in FIG. 2, a developing unit 9 and a cleaner unit 10 are set to a print frame unit 5. Additionally, the take-up type photoreceptor unit 4*a* or the clamp type photoreceptor unit 4*b*, both having substantially the same external shapes, is selectively inserted into the print frame unit 5.

Figure 3:
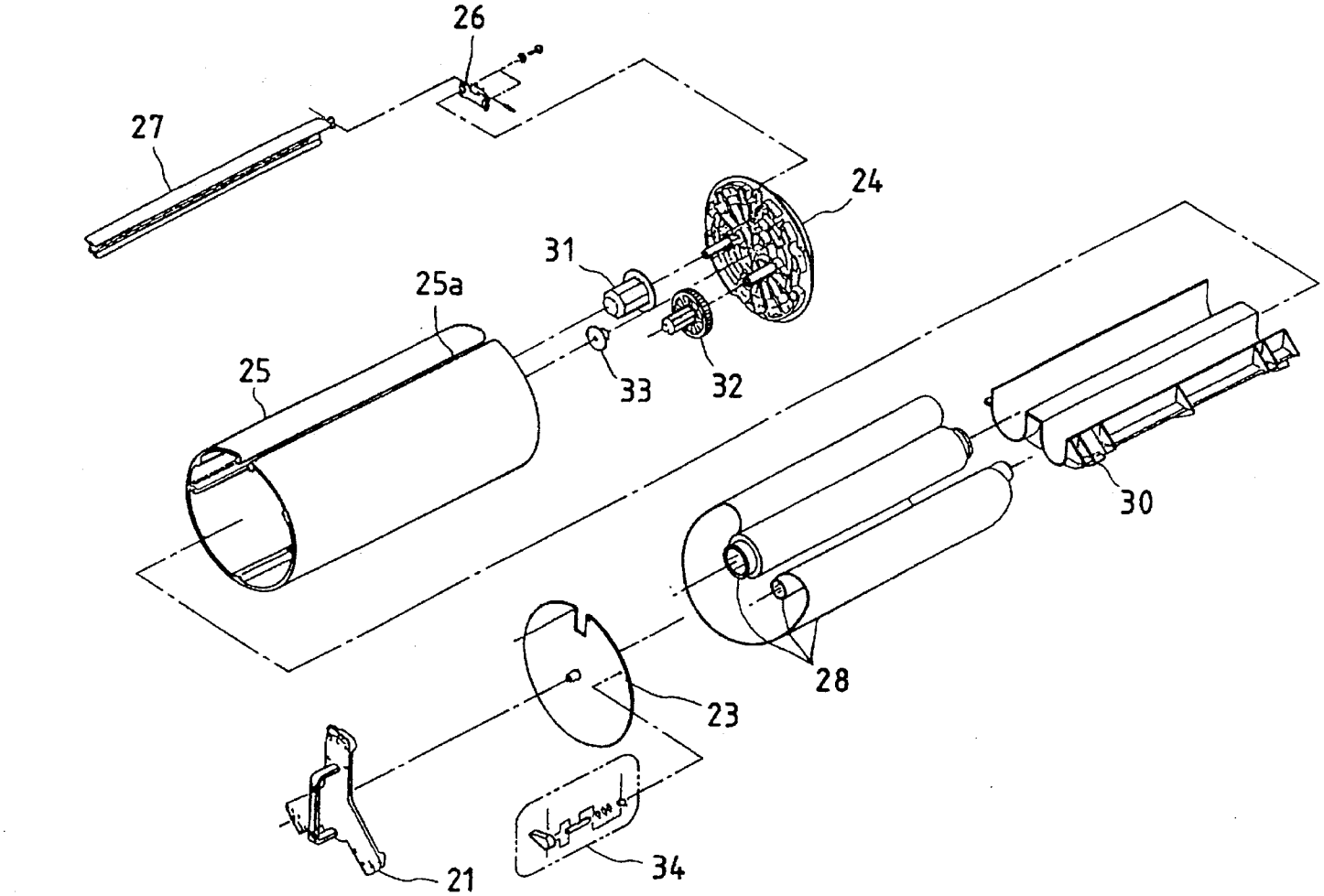
FIG. 3 is an exploded view in perspective showing the construction of a take-up type photoreceptor unit.

As shown in FIG. 3, the take-up type photoreceptor unit 4*a* is made up of a tubular base 25, the rear cap 24 attached to the rear end of the tubular base 25, a narrow opening 25*a* cutting apart the base along a line extending in the longitudinal direction thereof, a bar-like cap 27, having grooves on both sides, for closing the narrow opening 25*a* therewith, a cap hinge 26 joining the bar-like cap 27 and the rear cap 24 so that the bar-like cap 27 is turned against the tubular base 25, a stock sprocket 31 for supporting and driving a photoreceptor film roll assembly 28, a take-up gear 32, a take-up drive gear 33, a guide holder 30 serving as a guide means in setting the photoreceptor film roll assembly 28 into the photoreceptor unit, a front cap 23 arranged to close the front end of the tubular base 25, a tension lever assembly 34 for pressing a photoreceptor film on the circumferential outer surface of the tubular base 25, and a front frame 21.

Figure 4:
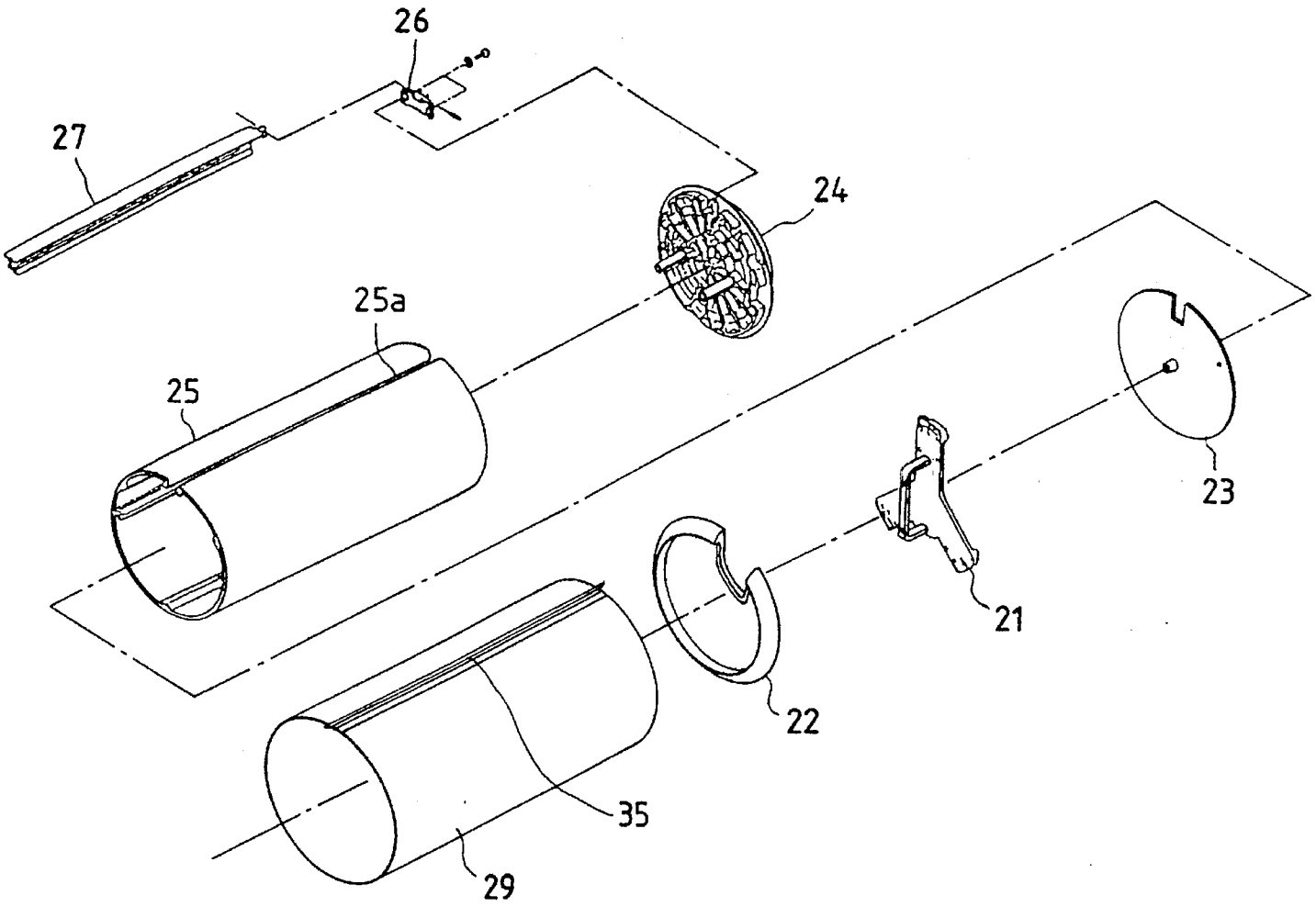
FIG. 4 is an exploded view in perspective showing the construction of a clamp type photoreceptor unit.

As shown in FIG. 4, the clamp type photoreceptor unit 4*b*, like the take-up type photoreceptor unit 4*a*, is made up of a tubular base or substantially cylindrical support 25, a rear cap 24, a hinge 26, a bar-like photoconductor cap 27, a front cap 23, and a front frame 21. The rear cap 24 forms a photoreceptor supporting means which is provided commonly to both the take-up type photoreceptor unit 4*a* and the clamp type unit 4*b*. An endless film assembly 29 having the circumferential length, which is longer than that of the tubular base 25 by a predetermined length, is used for the photoreceptor. The endless film assembly 29 is fitted to the tubular base 25 in such a way that the bar-like cap 27 is turned upward about the hinge 26, the endless film assembly 29 is guided by a tapered guide ring 22 attached to the front frame 21, a guide bar 35 is inserted into an elongated groove 27*a* formed in the bottom of the bar-like cap 27 (see FIG. 7(*c*)), up to a predetermined position, and the bar-like cap 27 is turned toward the narrow opening 25*a* of the tubular base 25 and clamped thereto. The guide bar 35, as shown in FIG. 7(*b*), has an elastic structure 35*a* in the lower part and is attached to the photo receptive film. With the elastic structure 35*a*, when the bar-like cap 27 is closed, the guide bar 35 presses the photoreceptor against the tubular base 25 (see FIG. 7(*c*)). In the present embodiment, the guide bar 35 is a molded product made of ABS resin. To form the elastic structure, the elasticity of the ABS resin is utilized.

Figure 5:
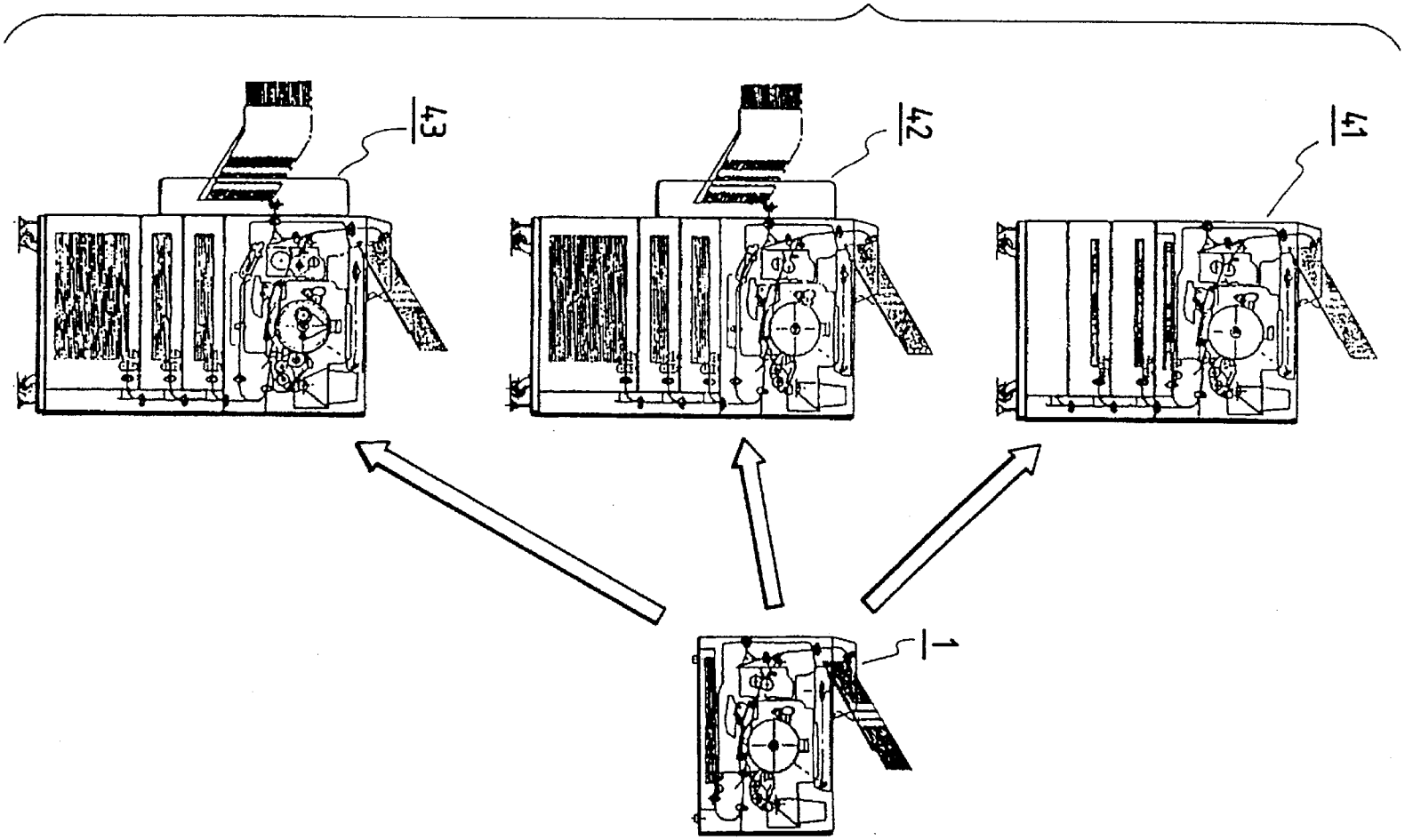
FIG. 5 is a diagram showing a variation of series models of the image forming apparatus.

FIG. 5 is a diagram showing a variety of series modules of the image forming apparatus. In this instance, several models of the image forming apparatus having different printing speeds and different duties are constructed on the basis of the base machine 1. The clamp type photoreceptor unit 4*b* is used for the photoreceptors of image forming apparatuses 41 and 42 of 26 PPM (page per minute) and 40 PPM in printing speed. The take-up type photoreceptor unit 4*a* is used for the photoreceptor of an image forming apparatus 43 of 60 PPM.

Figure 6:
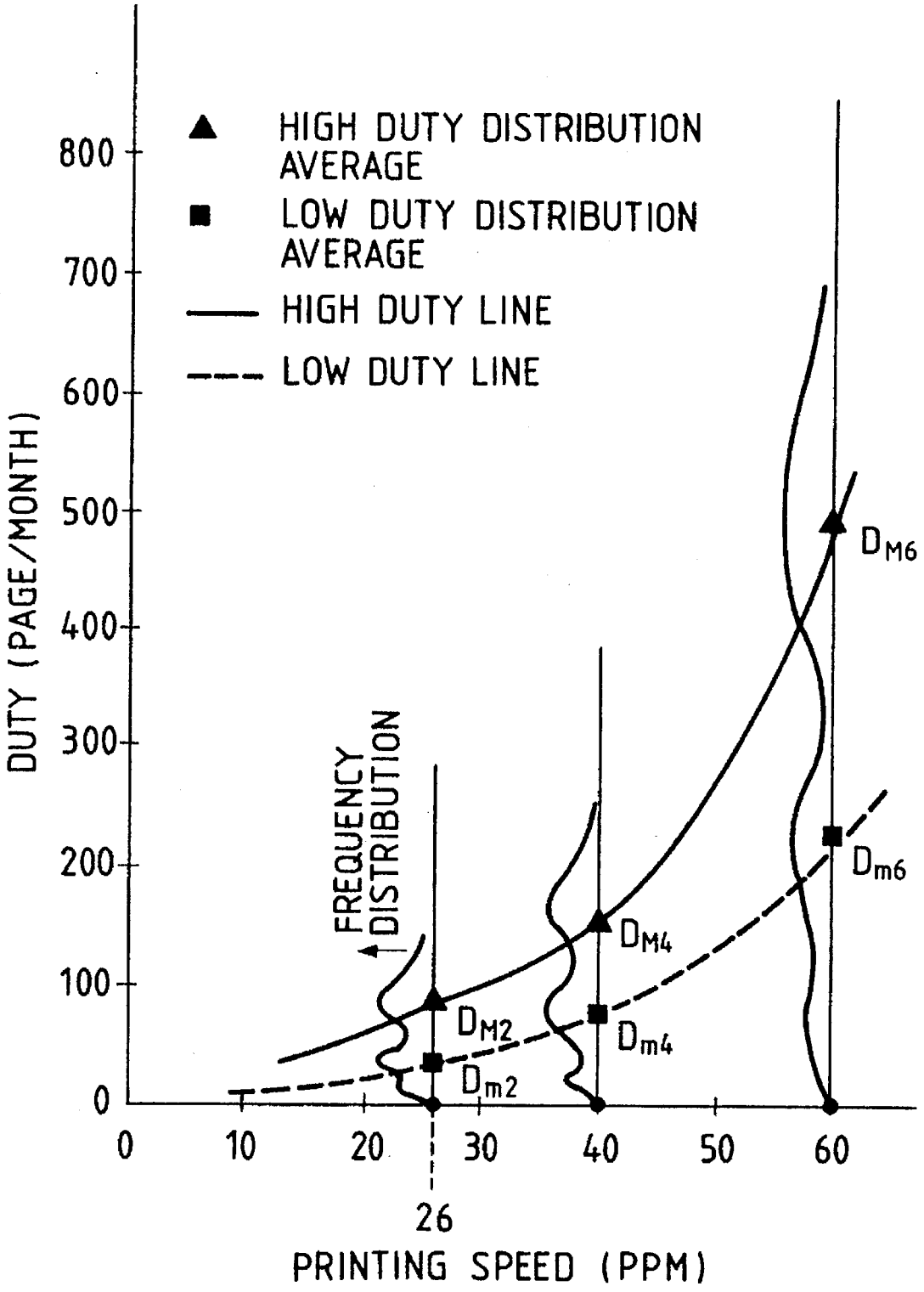
FIG. 6 is a graph showing the relationship between duty and printing speed.
Figure 7A:
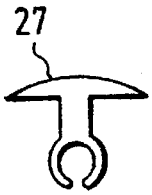
FIGS. 7(*a*) and 7(*b*) are explanatory diagrams showing the constructions of a cap and a guide bar, respectively and FIG. 7(*c*) shows the attachment of the guide bar to the photoreceptor film assembly.
Figures 1, 7A:
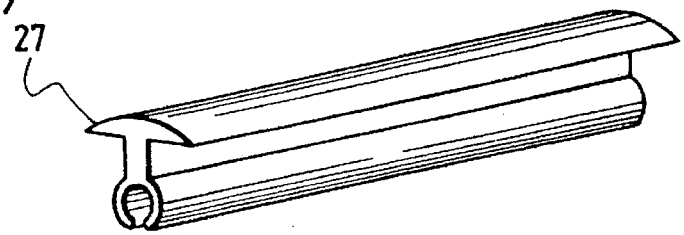
Figure 7B:
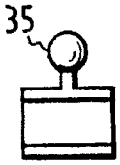
Figures 1, 7B:
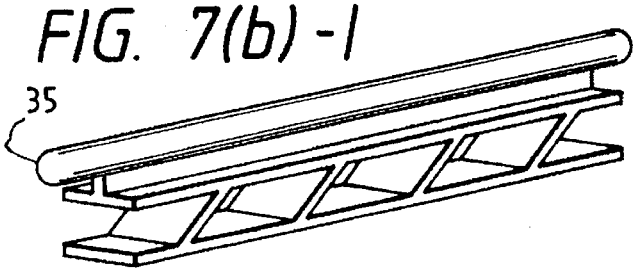

FIG. 6 is a graph showing the relationship between duty and printing speed. In the graph, the abscissa represents the printing speed (PPM) and the ordinate represents the duty (K page per month). Frequency distributions of duty are plotted for the printing speeds 26, 40 and 60 PPM of those models. The frequency distributions having their mean values in a relatively low duty for the distribution processing and in a relatively high duty for the central processing are depicted in the graph. The former mean value is called the mean value of a low duty distribution. A dotted line connecting those mean values indicates a low duty line. The latter mean value is called the mean value of a high duty distribution. A solid line connecting these mean values indicates a high duty line.

Figure 8A:
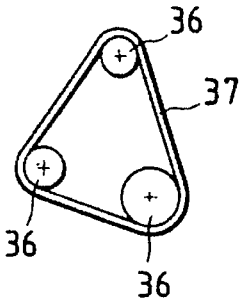
FIGS. 8(*a*) and S(*b*) are diagrams showing the construction of a photoreceptor unit used in another embodiment of the present invention.
Figure 8B:
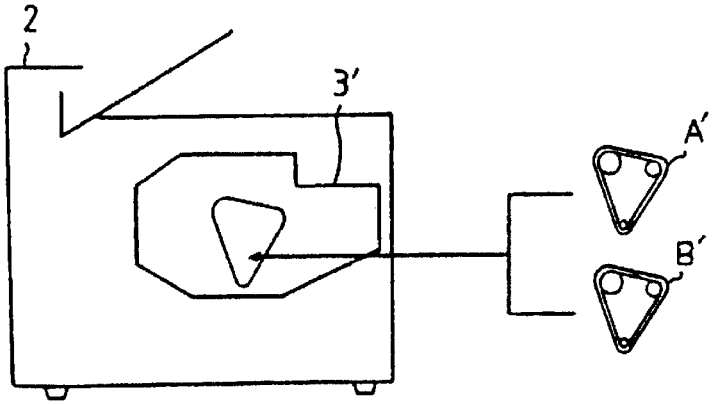
Figure 7C:
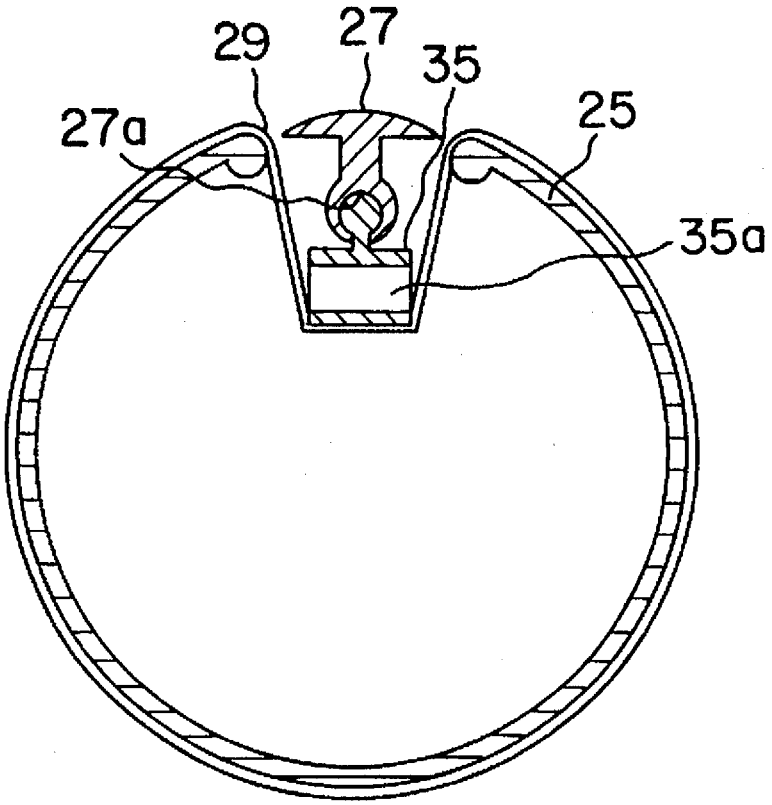

The image forming apparatus thus far described uses the photoreceptor units of the tubular type, such as the take-up type photoreceptor unit, the clamp type photoreceptor unit, and the drum type photoreceptor unit. It is evident that other types of photoreceptor unit may be used in addition to those of the tubular type. The photoreceptor units of the belt type in which photoreceptor belts 37 are wound around rollers 36 as shown in FIGS. 8(*a*) and 9(*a*) may also be used. Plural types of the belt-type photoreceptor units are selectively used in accordance with the specifications of the image forming apparatuses used.

More specifically, in the case of using the belt-type photoreceptor shown in FIGS. 8(*a*) and 9(*a*), since the form of the photoreceptor unit is different from that of the drum type photoreceptor units 4*a* and 4*b*, a single print module 3 cannot be commonly used therefor.

Figure 9A:
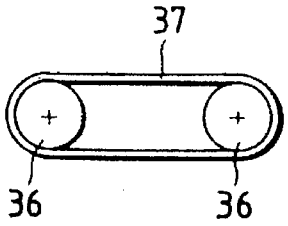
FIGS. 9(*a*) and 9(*b*) are diagrams showing the construction of another photoreceptor unit used in yet another embodiment of the present invention.
Figure 9B:
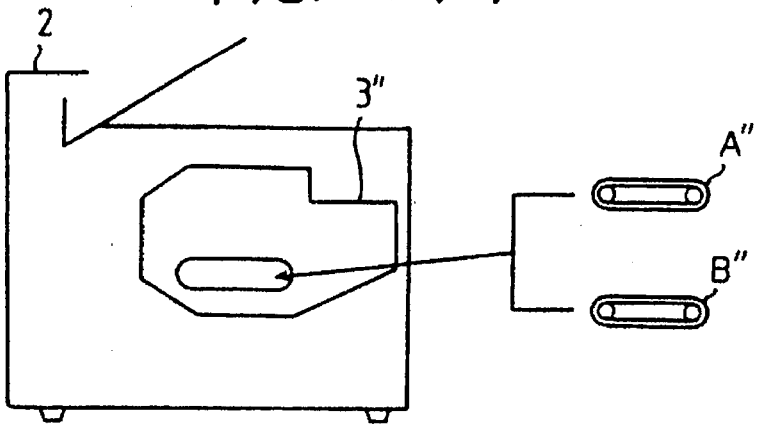

Therefore, in the case of using the photoreceptor unit of the type shown in FIG. 8(*a*), a print module 3' exclusive for that unit is prepared (see FIG. 8(*b*)), and in the case of using the photoreceptor unit of the type shown in FIG. 9(*a*), a print module 3" exclusive for that unit is prepared (see FIG. 9(*b*)).

As seen from the foregoing description, plural types of photoreceptor units, which are interchangeably set to the base machine of the image forming apparatus, are used for the photoreceptor. Accordingly, it is easy to form a variety of model series of the image forming apparatuses of different printing speeds or duties. Further, many components, such as parts and units, may be constructed as common components for those models of the image forming apparatus. This leads to reduction of the cost of production.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical explanation to enable one skilled in the art to utilize the invention in various embodiments and with various modifications as are suited to the particular use contemplated. It is intended that the scope of the invention bedefined by the claims appended hereto, and their equivalents.

What is claimed is:

1. A film photoconductor holding mechanism, comprising:

a substantially-cylindrical support having an opening which is shaped so as to have a notch at a part of a circumferential portion of said support in a longitudinal direction thereof;

a bar-like photoconductor cap which is operative to engage with said opening of said support;

a film assembly having a peripheral length larger than an outer peripheral length of said support and being installed into said support in a state where said bar-like photoconductor cap is opened and being held in said support by said bar-like photoconductor cap;

a guide bar, disposed on said film assembly, for guiding the installation of said film assembly in said support; and a guide groove defined in said bar-like photoconductor cap and engaged with said guide bar.

2. The film photoconductor holding mechanism as claimed in claim 1, wherein said film assembly has an elastic member that holds said film assembly in said support by a predetermined tension after said film assembly has been installed in said support.

3. A film photoconductor which is held by a substantially-cylindrical support having an opening which is shaped so as to have a notch at a part of a circumferential portion of said support in a longitudinal direction thereof, said film photoconductor comprising:

a film which defines a side surface; and a guide bar, disposed at the side surface of the film of said film photoconductor, for guiding installation of the film in said support.

4. A film photoconductor which is held by a substantially-cylindrical support having an opening which is shaped so as to have a notch at a part of a circumferential portion of said support in a longitudinal direction thereof, said film photoconductor comprising:

a film which defines a side surface; and an elastic member, disposed at the side surface of the film of said film photoconductor, for holding the film in said support by a predetermined tension after the film has been installed in said support.

5. A film photoconductor which is held by a substantially-cylindrical support having an opening which is shaped so as to have a notch at a part of a circumferential portion of said support in a longitudinal direction thereof, said film photoconductor comprising:

a film which defines a side surface;

a guide bar, disposed at the side surface of the film of said film photoconductor, for guiding installation of the film in said support; and an elastic member, disposed at the side surface of the film of said film photoconductor, for holding the film in said support by a predetermined tension after the film has been installed in said support.

6. The film photoconductor as claimed in claim 5, wherein said, guide bar and said elastic member are formed integrally with each other.

7. The film photoconductor as claimed in claim 5, wherein said film photoconductor is formed into an endless shape by joining both ends of the film to each other at a joint portion, and a member having said elastic member integrated with said guide bar is engaged with the joint portion of the film.

8. A film photoconductor holding mechanism, comprising:

a substantially-cylindrical support having an opening which is shaped so as to have a notch at a part of a circumferential portion of said support in a longitudinal direction thereof;

a bar-like photoconductor cap which is operative to engage with said opening of said support;

a film having a peripheral length larger than an outer peripheral length of said support and being installed into said support in a state where said bar-like photoconductor cap is opened and being held in said support by said bar-like photoconductor cap; and a guide ring, disposed in an end portion of said support in the longitudinal direction thereof, for shaping the film when installing the film into said support and for guiding engagement of the film during installation.

9. The film photoconductor holding mechanism as claimed in claim 8, wherein said guide ring has a tapered side surface.

* * * * *